United States Patent [19]

Gordon et al.

[11] 4,270,515

[45] Jun. 2, 1981

[54] FIREPLACE HAVING INTEGRAL GRATE

[75] Inventors: Leonard J. Gordon; Frank A. Myers, both of Auburn, Ala.

[73] Assignee: Vega Industries, Inc., Des Moines, Iowa

[21] Appl. No.: 83,673

[22] Filed: Oct. 11, 1979

[51] Int. Cl.[3] ..... F23H 3/04

[52] U.S. Cl. ..... 126/164

[58] Field of Search ..... 126/120, 121, 164, 165, 126/163 R, 163 A, 152 A, 152 B

[56] References Cited

U.S. PATENT DOCUMENTS

| | | | |
|---|---|---|---|
| 2,843,109 | 7/1958 | Chapla | 126/165 |
| 2,893,375 | 7/1959 | Emmons | 126/165 |
| 3,682,158 | 8/1972 | Thomas | 126/165 |
| 3,987,779 | 10/1976 | Richardson | 126/165 |
| 4,069,808 | 1/1978 | Cranberg | 126/164 |

FOREIGN PATENT DOCUMENTS

| | | | |
|---|---|---|---|
| 335255 | 9/1930 | United Kingdom | 126/164 |

*Primary Examiner*—James C. Yeung

*Attorney, Agent, or Firm*—Zarley, McKee, Thomte, Voorhees & Sease

[57] ABSTRACT

The present invention relates to an improvement in a fireplace having a hearth and a firebox with side walls and a back wall. A pair of brackets are attached to each of the side walls and the brackets each pivotally receive a stub shaft extending from a grate within the fireplace. The grate is pivotally mounted by virtue of the stubs extending into the brackets, and the grate includes a plurality of legs which normally engage the hearth of the fireplace.

5 Claims, 5 Drawing Figures

FIREPLACE HAVING INTEGRAL GRATE

BACKGROUND OF THE INVENTION

This invention relates to a fireplace having an integral grate therein.

After a new fireplace has been installed in a home, the homeowner must purchase a grate to be used therein for supporting the wood a short distance above the hearth floor. These grates are not attached in any way to the fireplace, but merely rest upon several supporting legs (usually four).

Because the presently known grates are not attached in any way to the fireplace, they are free to move about on the hearth of the fireplace. Accordingly, they are not always positioned properly for the most efficient burning of the wood and for safety.

Also in presently known grates, it is desirable to minimize the number of legs so as to facilitate cleaning of the ashes from beneath the grate. Accordingly, usually only four legs are used for the grate, and four legs are often insufficient to support the iron members which comprise the grate when the iron members are hot. Therefore, in many situations when the iron members become hot, they respond to the weight of the logs in the fireplace and begin to droop downwardly.

The cleaning of fireplaces having conventional grates therein is often difficult because the legs of the grates interfere with the cleaning process. It is necessary to lift the grate out of the fireplace in order to provide adequate cleaning. Thus, cleaning is often a cumbersome and dirty task.

Because the grate is free to move about on the hearth of the fireplace, there is the danger with present devices that the grate may move too close to the front edge of the fireplace, thereby creating the danger that logs may roll off the grate and outwardly through the open end of the fireplace into the room. If glass doors are used on the fireplace, there is the danger that the logs will roll against the glass doors.

SUMMARY OF THE PRESENT INVENTION

The present invention utilizes side hubs fixed to the interior walls of the fireplace for providing pivotal mounting of a grate within the fireplace. The grate may be pivoted upwardly about these pivotal hubs so as to lift the legs of the grate from the floor of the fireplace and thereby permit cleaning of ashes from beneath the grate.

The present invention offers increased support for logs of other wood by virtue of an increased number of vertical support legs. Most grates provide only four corner supports, whereas the present invention may utilize eight or more legs since these legs may easily be lifted off the floor of the fireplace.

The hinged hub arrangement allows the grate to be rotated out of the way for cleaning. Complete removal is accomplished by sliding the grate laterally to one side until its stub shafts clear one of the hubs at which point the grate may be moved outwardly and removed from the fireplace.

Therefore, a primary object of the present invention is the provision of an improved fireplace having an integral grate therein.

A further object of the present invention is the provision of a device which includes a grate attached to the interior of the fireplace so as to minimize the amount of movement of the grate within the fireplace.

A further object of the present invention is the provision of a grate which can be rotated out of the way for cleaning, and which can be removed from the fireplace when desired.

A further object of the present invention is the provision of a grate which has an increased number of vertical legs over prior art grates so as to provide adequate support for the logs or other wood being burned.

A further object of the present invention is the provision of a device which improves the safety of the fireplace by minimizing the likelihood that the grate will move towards the forward open end of the fireplace.

A further object of the present invention is the provision of a fireplace which can be sold with the grate already in place rather than requiring the purchaser to purchase a grate separately for use with the fireplace.

A further object of the present invention is the provision of a device which is economical in manufacture and efficient in operation.

DETAILED DESCRIPTION OF THE INVENTION

Figure 1:
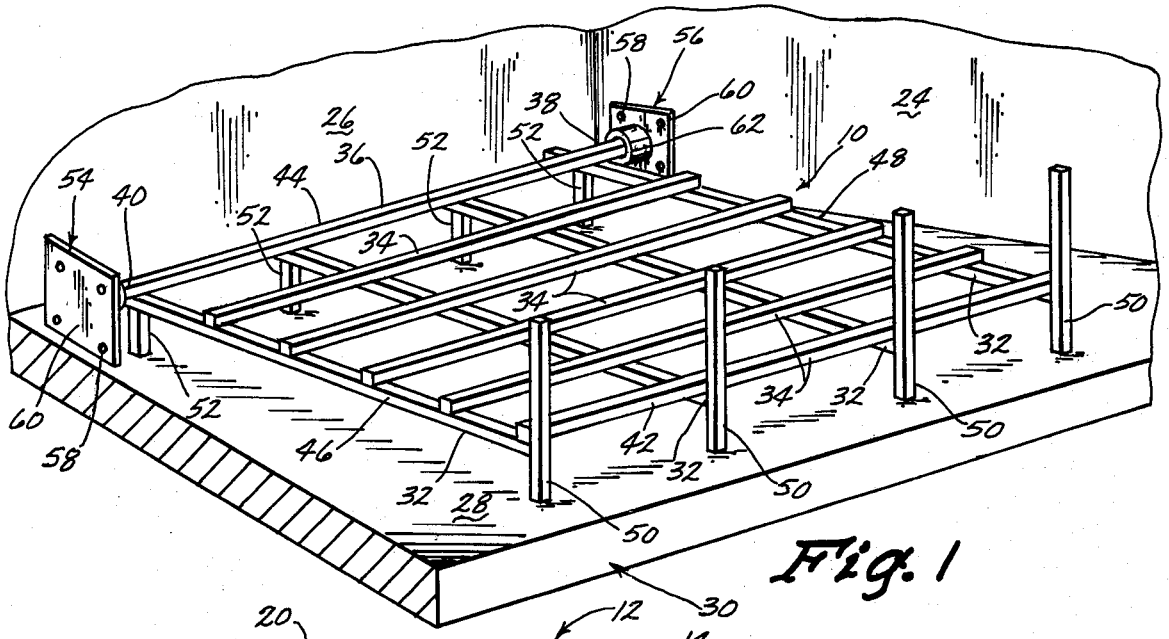
FIG. 1 is a perspective view of the interior of a fireplace having a grate mounted therein.
Figure 2:
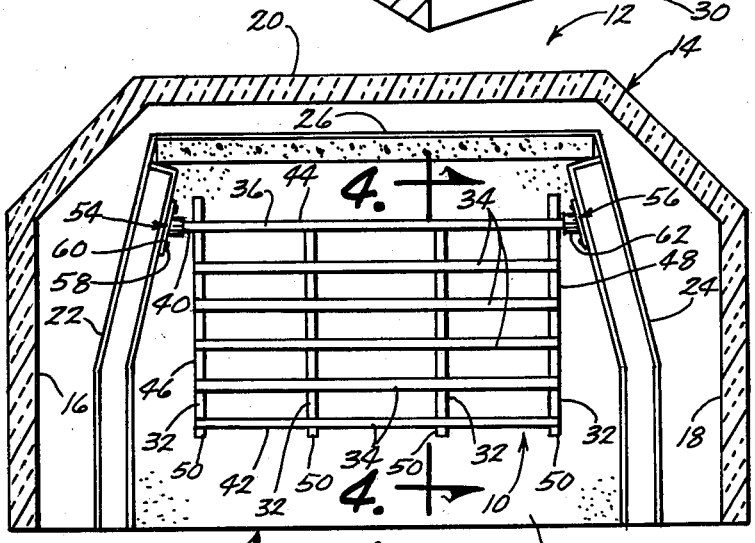
FIG. 2 is a top sectional view of a fireplace having an integral grate mounted therein.
Figure 3:
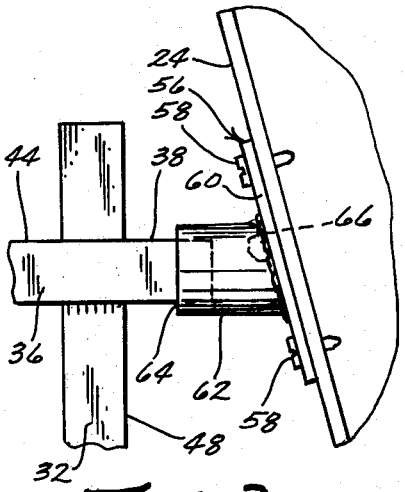
FIG. 3 is a detailed plan view of one of the hinged hubs which provide pivotal mounting of the grate.

Referring to the drawings, the numeral 10 generally designates a grate which is integrally mounted within a fireplace designated by the numeral 12. Fireplace 12 comprises an outer housing 14 having outer side walls 16 and 18, and a rear wall 20. Spaced inwardly from side walls 16 and 18 respectively, are a pair of inner side walls 22, 24 which are adjoined adjacent their rearward ends by a rear inner wall 26. Inner side walls 22, 24 and inner rear wall 26 form a firebox generally designated by the numeral 28, having a hearth floor 30 therein.

Grate 10 is comprised of a plurality of spaced apart parallel first members 32, and a plurality of parallel spaced apart second members 34 which are transversely arranged with respect to first members 32. A hinge member 36 is positioned at the rear of the grate and is parallel to second members 34. Hinge member 36 includes opposite ends which extend slightly longer than the ends of members 34 so as to form a pair of outwardly projecting stub shafts 38, 40.

Members 32, 34, 36 provide a matrix configuration having a forward edge 42, a rearward edge 44, and opposite lateral edges 46, 48.

Positioned along forward edge 42 are four upstanding legs 50 each of which is secured intermediate its length to the matrix configuration so that legs 50 extend downwardly from the matrix configuration and also upwardly therefrom. The downwardly projecting portions of legs 50 engage hearth floor 30, and the upwardly projecting portions serve to engage and hold logs or other burning material against rolling outwardly from the fireplace.

Along rear edge 44, a plurality of shorter downwardly projecting legs 52 are provided for engaging the hearth floor 30 and supporting the grate.

A pair of hub brackets 54, 56 are each secured to side walls 22, 24, respectively, by means of screws 58 or other securing means. Hub brackets 54, 56 each comprise a plate 60 mounted in facing engagement with side walls 22, 24 by screws 58. Welded or otherwise secured to plate 60 is an inwardly projecting sleeve 62. The sleeves 62 of brackets 54, 56 have their longitudinal cylindrical axis thereof in registered alignment with one another and also in registered alignment with stub shafts 38, 40 of hinge member 36. This means that the longitudinal cylindrical axes of sleeves 62 are obliquely presented with respect to the surface of plate 60.

Each sleeve 62 terminates inwardly in an open end 64 and includes a closed end 66 provided by plate 60.

The length of hinge member 36 is greater than the distance between open ends 64 of sleeves 62. However, the length of member 36 is slightly less than the distance from closed end 66 of one sleeve 62 and open end 64 of the other sleeve 62. Thus, by sliding grate 12 either to the right or the left, it is possible to cause one end of hinge shaft 36 to clear one of the sleeves, thereby permitting removal of grate 12 when removal is desired.

In operation, grate 12 is lowered to the position shown in FIG. 1 and is used to support the combustible materials burning within the fireplace. The grate does not move and consequently there is minimization of the danger that the grate will move towards the forward end of the fireplace. The grate can be lifted out of the way for cleaning merely by pivoting it upwardly about the hinged axis provided by hubs 54, 56. This causes the legs 50, 52 to be removed from the hearth floor and permits cleaning. While eight legs 50, 52 are shown in the drawings, it is possible to use even more legs to provide adequate support for the grate. This is to be contrasted with prior art devices which used only four legs so as to minimize the amount of interference with cleaning. This is not a problem with the present invention inasmuch as the legs may be pivoted out of the way for cleaning.

The grate is integral with the fireplace, and can be sold as a unit with the fireplace so as to eliminate the need for the purchaser to make a separate purchase.

Figure 4:
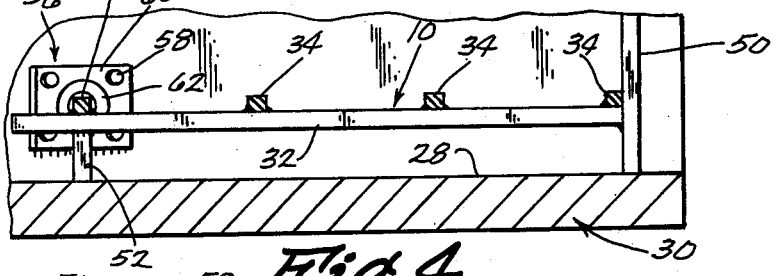
FIG. 4 is a sectional view taken along line 4—4 of FIG. 2.
Figure 5:
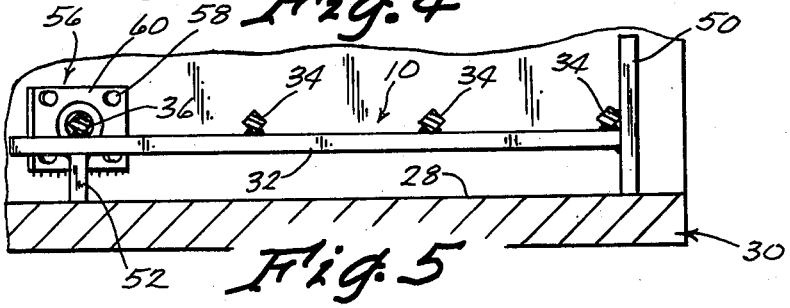
FIG. 5 is a sectional view similar to FIG. 4, but showing a modified configuration of the grate of the present invention.

Referring to FIGS. 4 and 5, two alternative ways are shown for mounting cross-members 32, 34 with respect to one another. FIG. 4 shows members 34 mounted to members 32 with flat side facing flat side which provides a strong inter connection between the two parts.

FIG. 4 shows mounting with the angle side of members 34 welded to the flat side of members 32, which increases the resistance to bending in the vertical direction due to the increased section modules of members 34.

Thus, the device accomplishes at least all of its stated objectives.

What is claimed is:

1. An improvement in a fireplace comprising a hearth, having sides, a forward edge and a rear edge; side walls; and a back wall, said improvement comprising:

a pair of brackets, each of which is rigidly attached to one of said side walls adjacent said rear wall, said brackets each having a cylindrical sleeve projecting perpendicularly inwardly from said sidewalls and terminating in an open cylindrical end, the cylindrical axes of said sleeves being in registered alignment;

a grate comprised of a plurality of first members extending in one direction and a plurality of second members extending in the opposite direction and being attached to said first members to provide a matrix configuration, at least two upstanding members attached to said matrix configuration and extending above and below said matrix configuration adjacent said forward edge of said hearth;

said grate being pivotally and removably mounted within said brackets, said grate having at least two stub shafts extending laterally outwardly in opposite directions and being loosely fitted within said sleeves to provide a horizontal hinge axis for said grate, said sleeves completely surrounding said stub shafts, said stub shafts terminating in outwardly presented ends, the distance between said outwardly presented ends being greater than the distance between said open cylindrical ends of said sleeves, said sleeves each having a closed outer end, the distance between said outwardly presented ends of said stub shafts being less than the distance from said closed end of one of said sleeves to said open end of the other of said sleeves.

2. An improvement according to claim 1 wherein said matrix configuration includes a forward edge and a rearward edge, a plurality of said upstanding members being attached to said matrix configuration along said forward edge and adjacent said rearward edge.

3. An improvement according to claim 1 wherein first and second members are rectangular in cross section to create four flat sides on each of said first and second members.

4. An improvement according to claim 3 wherein one of said flat sides of said first members face against and are secured to one of said flat sides of said second members.

5. An improvement according to claim 3 wherein said first members are oriented with one cross sectional rectangular apex resting upon and attached to one of said flat surfaces of said first members.

* * * * *